United States Patent [19]

Murakami

[11] 4,148,183

[45] Apr. 10, 1979

[54] SUPPORTING STRUCTURE FOR QUARTZ OSCILLATOR

[75] Inventor: Tomomi Murakami, Higashiyamato, Japan

[73] Assignee: Citizen Watch Company Limited, Tokyo, Japan

[21] Appl. No.: 789,156

[22] Filed: Apr. 20, 1977

[30] Foreign Application Priority Data

Apr. 24, 1976 [JP] Japan ..... 51/46834
Jul. 1, 1976 [JP] Japan ..... 51/78445

[51] Int. Cl.[2] ..... G04C 3/00
[52] U.S. Cl. ..... 58/23 V; 58/23 AC; 58/23 A; 310/340; 310/345
[58] Field of Search ..... 361/403, 418; 174/138 G; 310/9.1, 345, 340; 58/23 R, 23 TF, 23 V, 23 AC, 50 R, 23 A

[56] References Cited

U.S. PATENT DOCUMENTS

| | | | |
|---|---|---|---|
| 3,612,749 | 10/1971 | Grube et al. | 361/418 |
| 3,759,031 | 9/1973 | McCullough et al. | 58/23 R X |
| 3,760,584 | 9/1973 | Dargent | 58/50 R |
| 3,925,693 | 12/1975 | Meister et al. | 58/23 R X |
| 3,996,735 | 12/1976 | Zurcher | 58/23 R |

*Primary Examiner*—Ulysses Weldon
*Attorney, Agent, or Firm*—Frank J. Jordan

[57] ABSTRACT

A supporting structure for a quartz oscillator having terminal pins extending from one end portion of the oscillator in an electronic timepiece having a circuit substrate supporting the one end portion of the oscillator by means of the terminal pins connected thereto, which supporting structure comprises a flat portion held between the quartz oscillator, connected to the circuit substrate, and the circuit substrate, a vertical projection extending from the flat portion and engaging the outer periphery of the quartz oscillator, and at least one hook portion extending from the flat portion and engaging the flange of the quartz oscillator at another end thereof.

9 Claims, 5 Drawing Figures

SUPPORTING STRUCTURE FOR QUARTZ OSCILLATOR

This invention relates to electronic timepieces and, more particularly, to a structure for supporting a quartz oscillator in such timepieces.

In electronic timepieces equipped with a quartz oscillator having a pair of external terminals at one end, it has been a common practice to solder the terminals to a circuit substrate of the timepiece and then either employ a bonding process according to which the quartz oscillator is adhered to the circuit substrate, or a method which makes use of a metal leaf spring to secure the oscillator to the circuit substrate. However, both of these methods posesses certain disadvantages. The bonding method, for example, is time consuming and can not provide bonding reliability owing to the small size of the oscillator. On the other hand, the method which utilizes a spring requires too many components to mount the spring and the actual procedure is difficult. Furthermore, in view of the timepiece arrangement, there is no need for the circuit substrate to directly support the quartz oscillator; it is sufficient merely to electrically connect the oscillator terminals to the circuit substrate.

It is, therefore, an object of the present invention to provide a supporting structure for a quartz oscillator which is not beset by the aforementioned defects and yet which is readily assembled and capable of providing improved impact resistance.

It is another object of the present invention to provide a supporting structure for a quartz oscillator which is simple in construction and low in manufacturing cost.

These and other objects, features and advantages of the present invention will become more apparent from the following description when taken in conjunction with the accompanying drawings, in which.

Figure 1:
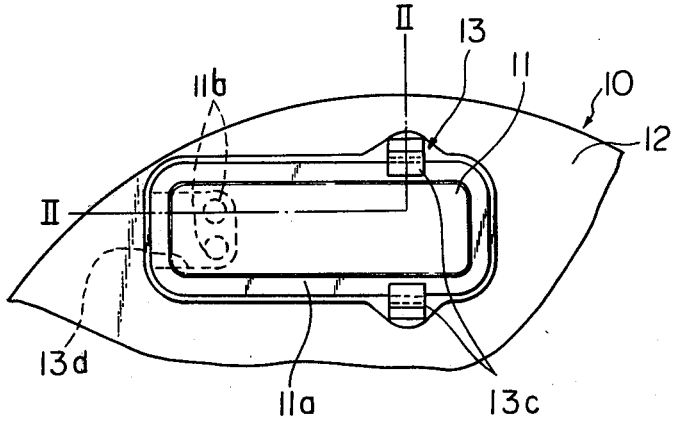
FIG. 1 is a plan view showing a first preferred embodiment of a supporting structure according to the present invention by which a quartz oscillator is assembled to a circuit substrate of an electronic timepiece.
Figure 2:
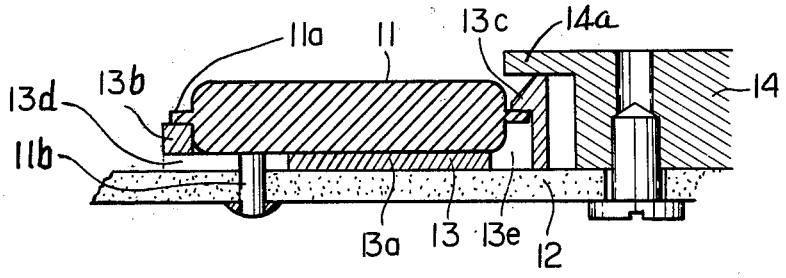
FIG. 2 is a cross sectional view taken along line II—II of FIG. 1.

Referring now to FIGS. 1 and 2, there is shown a portion of an electronic timepiece 10 in which a quartz oscillator 11 is mounted on a circuit substrate 12 by means of a supporting structure according to the present invention. The quartz oscillator 11 has a pair of terminal pins 11*b* extending from one end portion of the oscillator, which are pins connected to a wiring pattern provided on the circuit substrate 12 by some suitable means such as soldering. The supporting structure is composed of supporting or cushioning member 13 made of elastic material such as plastic. The supporting member 13 has a flat portion 13*a* sandwiched between the quartz oscillator 11 and the circuit substrate 12 supporting the one end portions of the oscillator, a vertical portion 13*b* projecting upwardly from the flat portion around the periphery thereof and fitting around an outer periphery of the oscillator, and at least one hook 13*c* extending vertically from the flat portion at a position away from the terminal pins 11*b* of the oscillator the one end portion of which is rigidly connected to and supported by the circuit substrate and engaging a flange 11*a* of the oscillator at another end portion thereof 11. The supporting member 13 also has a notch 13*d* formed in the flat portion 13*a* adjacent the terminal pins 11*b* so as to allow the removal of residual cleaning agent being used to clean the terminal pins following the soldering procedure. Indicated at 13*e* is a slot formed in the flat portion 13*a* adjacent the hooks 13*c* to provide a greater elasticity thereto.

According to the above mentioned construction, the quartz oscillator 11 is mounted on the circuit substrate 12 in such a manner as to hold the supporting member 13 therebetween. Thus, as can be appreciated from FIG. 2, a portion of the supporting member 13 is inserted and held between a lateral base extension of a base plate 14 for a timepiece and circuit substrate 12 and is accordingly perfectly secured since circuit substrate 12 is fixed to the base plate 14. In consequence, the oscillator 11 is fixed by the hook 13*c* of the supporting member 13 due to the fact that the supporting member is held between the base plate 14 and circuit substrate 12. Moreover, the supporting member can, instead of metal base plate 14, be held between a timepiece cover, bridge or case, and through the intermediary of a rigid bridge member.

Accordingly, when a timepiece is subjected to an impact, the quartz oscillator 11 sustains the impact through the intermediary of the oscillator supporting member 13 so that the impact is alleviated by the resiliency of the supporting member. In addition, assembly is a simple matter since only two hooks 13*c* are manipulated so as to merely engage the oscillator, an advantage that does away with the troublesome conventional bonding method. It is also possible to suitably position quartz oscillator 11 in a horizontal plane by appropriately positioning the supporting member with respect to other components and then securing it. This is another important advantage in view of the fact that it was hitherto necessary to provide a large amount of space around the quartz oscillator to prevent it from striking other components upon impact.

Figure 3:
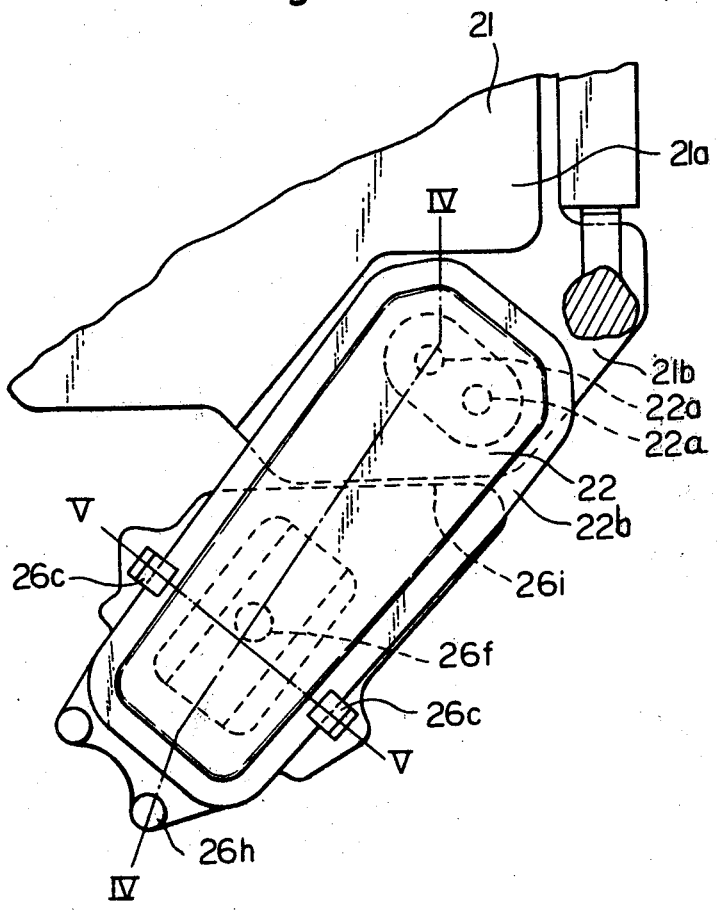
FIG. 3 is a plan view showing a second preferred embodiment of a supporting structure according to the present invention.
Figure 4:
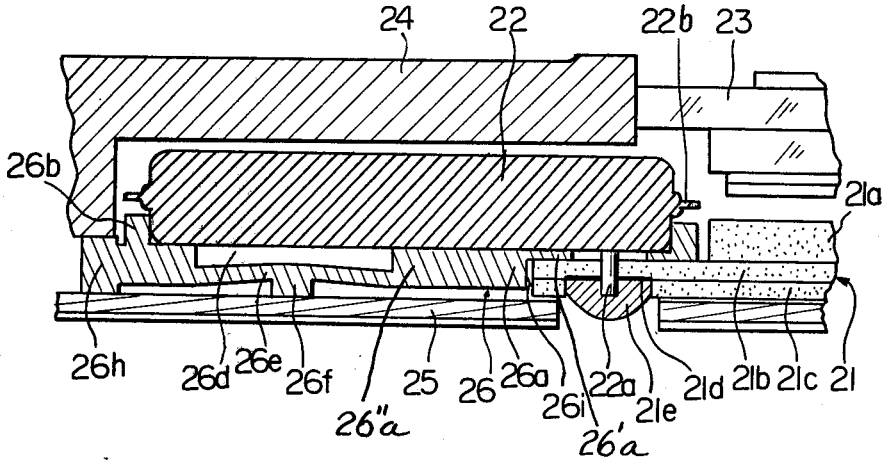
FIG. 4 is a cross sectional view taken on line IV—IV of FIG. 3.
Figure 5:
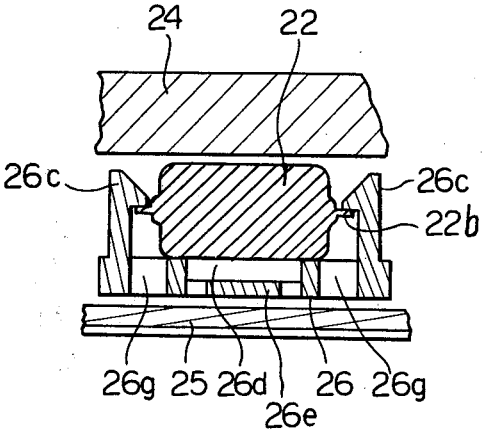
FIG. 5 is a cross sectional view taken on line V—V of FIG. 3.

A second preferred embodiment of the present invention is illustrated in FIGS. 3 to 5. In FIGS. 3 to 5, timepiece circuit substrate 21 made of ceramic material or the like is composed of three overlapping layers 21*a*, 21*b*, 21*c*, and is provided with a circuit chip and a wired metalized pattern. Reference numeral 21*d* denotes a wiring pattern for connecting the circuit chip (not shown) to external terminal pins 22*a* of a quartz oscillator 22 which is supported by an end portion of the circuit substrate by means of terminal pins 22*a* connected thereto. As can be seen in the drawings, the quartz oscillator is an oblong structure with a pair of external terminal pins 22*a* provided at one end. Terminal pins 22*a* are soldered to pattern 21*d* on the circuit substrate 21 by means of solder 21*e*. Reference numeral 23 denotes a liquid crystal cell, reference numeral 24 a liquid crystal cell positioning member for levelling liquid crystal cell 23, and reference numeral 25 a supporting plate for supporting circuit substrate 21. In this illustrated embodiment, a quartz oscillator supporting member 26 is supported by the liquid crystal cell supporting member 24 and supporting plate 25 so as to be structurally positioned and retrained. The quartz oscillator supporting member 26 is secured between the quartz oscillator 22 and the circuit substrate 21 and is made of a shock absorbing material such as plastic which exhibits elasticity. The quartz oscillator supporting member 26 has a flat portion 26*a* composed of a first section 26'*a* sandwiched between a bottom wall of the quartz oscillator and the end portion of the circuit substrate 21 and a second section 26''*a* integral with the first section and engaging the bottom wall of the oscillator 22, a dowel 26*h* integral with the second section of the flat section 26*a* and sandwiched between the cell supporting member 24 and the supporting plate 25, a vertical projection 26*b*, vertically extending from the flat portion 26*a* and engaging an outer periphery of the oscillator 22, and at least one hook portion 26*c* extending from the second section of the flat portion 26*a* at a position away from the first section and retaining the flange 22*b* of the oscillator to support another end portion of the oscillator. The second section 26''*a* of the flat portion 26 has a recess 26*d*, a thin wall portion 26*e* facing thereto, and a downward projection 26*f* integral with the thin wall portion 26*e* and engaging an upper surface of the supporting plate 25. The supporting member 26 is further provided with slots 26*g* adjacent the hooks 26*c* to provide an elasticity thereto as in the first embodiment.

The quartz oscillator 22 is positioned with respect to the circuit substrate 21 by the flange 26*b* of the quartz oscillator supporting member 26 and by the shape of the circuit substrate 21. When the circuit substrate 21 to which the quartz oscillator 22 is connected is installed in a timepiece, the circuit substrate 21 is supported by the supporting plate 25. In this case, the combination recess 26*d*, thin wall portion 26*e* and projection 26*f* compensate for the variations in thickness of the layers 21*b* and 21*c* of the substrate 21. As shown in FIG. 4, the supporting member 26 has a dowel 26*h* at one end, which is sandwiched between the crystal cell supporting member 24 and the quartz oscillator supporting member 26.

When the quartz oscillator 22 is subjected to an impact, the structure and composition of quartz oscillator supporting member 26 permit the impact to be absorbed so as to protect crystal oscillator 22. In view of design and the fact that the ceramic circuit substrate 21 is extremely fragile, far more impact resistance is obtained by employing the quartz oscillator supporting member 26, which is made of a shock-absorbing material, to support quartz oscillator 22 with respect to the circuit substrate 21. This is more preferable than extending and enlarging the circuit substrate below the oscillator and greatly simplifies assembly. Indicated as 26*i* is a slanted wall of the supporting member 26.

While the present invention has been shown and described with reference to particular embodiments, it should be noted that various other changes or modifications may be made without departing from the scope of the present invention.

What is claimed is:

1. In an electronic timepiece having a quartz oscillator including terminal pins extending from one end portion of the quartz oscillator and a flange extending outwardly from an outer periphery of the quartz oscillator, a combination comprising:

a base plate;

a circuit substrate mounted on said base plate and supporting the one end portion of said quartz oscillator by means of said terminal pins connected thereto; and a supporting member made of elastic material and including a flat portion sandwiched between said quartz oscillator and said circuit substrate, a vertical portion projecting vertically from said flat portion and engaging the outer periphery of said quartz oscillator, and at least one hook portion extending vertically from said flat portion at a position away from said terminal pins of said quartz oscillator retained by said vertical portion and retaining the flange of said quartz oscillator at another end portion thereof.

2. A combination according to claim 1, in which said flat portion has a slot formed adjacent said hook portion to provide a larger elasticity thereto.

3. In an electronic timepiece having a quartz oscillator including terminal pins extending from one end portion of the quartz oscillator and a flange extending outwardly from an outer periphery of the quartz oscillator, a combination comprising:

a base plate having a lateral extension;

a circuit substrate mounted on said base plate and supporting the one end portion of said quartz oscillator by means of said terminal pins connected thereto; and a supporting member made of elastic material and including a flat portion sandwiched between said quartz oscillator and said circuit substrate, a vertical portion projecting vertically from said flat portion and engaging the outer periphery of said quartz oscillator, and at least one hook portion extending vertically from said flat portion at a position away from said terminal pins of said quartz oscillator retained by said vertical portion and held between the lateral extension of said base plate and said circuit substrate to urge the flange of said quartz oscillator for thereby retaining said quartz oscillator at another end portion thereof.

4. A combination according to claim 3, in which said flat portion has a slot formed adjacent said hook portion to provide a larger elasticity thereto.

5. In an electronic timepiece having, a liquid crystal cell, and terminal pins extending from one end portion of the quartz oscillator and a flange extending outwardly from an outer periphery of the quartz oscillator, a combination comprising:

a cell supporting member adapted to support the liquid crystal cell in place;

a circuit substrate having an end portion to which said terminal pins of said quartz oscillator is connected to support the one end of said quartz oscillator;

a supporting plate supporting thereon said circuit substrate; and a quartz oscillator supporting member made of elastic material and including a flat portion composed of a first section formed at one end of said flat portion and sandwiched between a bottom wall of said quartz oscillator and the end portion of said circuit substrate, and a second section integral with said first section and engaging the bottom wall of said quartz oscillator, a dowel integral with the second section of said flat portion and sandwiched between said cell supporting member and said supporting plate, a vertical projection vertically extending from said flat portion and engaging the outer periphery of said quartz oscillator, and at least one hook portion extending from the second section of said flat portion at a position away from said first section and retaining the flange of said quartz oscillator to support another end portion of said quartz oscillator.

6. A combination according to claim 5, in which said second section of said flat portion is spaced from said supporting plate and has a recess, a thin wall portion facing the recess, and a projection integral with the thin wall portion said projection extending toward and engaging with said supporting plate to provide said second section with a cushioning effect.

7. A combination according to claim 5, in which said quartz oscillator supporting member has a slot adjacent said hook portion to provide an increased elasticity thereto.

8. In an electronic timepiece having a quartz oscillator including terminal pins extending from one end portion of the quartz oscillator, a combination comprising:

a base plate having a lateral extension;

a circuit substrate mounted on said base plate and supporting the one end portion of said quartz oscillator by means of said terminal pins connected thereto; and a supporting member made of elastic material and including a flat portion, a vertical portion projecting vertically from said flat portion and engaging the side of said quartz oscillator, and at least one projection extending vertically from said vertical portion at a position away from said terminal pins of said quartz oscillator and held between the lateral extension of said base plate and said circuit substrate to urge the quartz oscillator for thereby retaining said quartz oscillator at another end portion thereof.

9. In an electronic timepiece having a quartz oscillator including terminal pins extending from one end portion of the quartz oscillator, a combination comprising:

a base plate having a lateral extension;

a circuit substrate mounted on said base plate and supporting the one end portion of said quartz oscillator by means of said terminal pins connected thereto; and a supporting member made of elastic material and interposed between said quartz oscillator and said circuit substrate, said supporting member including a flat portion supporting thereon said quartz oscillator, a vertical portion projecting vertically from said flat portion and engaging the side of said quartz oscillator, and at least one projection extending vertically from said flat portion at a position away from said terminal pins of said quartz oscillator for retaining said quartz oscillator at another end thereof.

* * * * *